US010847892B2

(12) United States Patent
Pla

(10) Patent No.: US 10,847,892 B2
(45) Date of Patent: Nov. 24, 2020

(54) WIDE BAND LOG PERIODIC REFLECTOR ANTENNA FOR CELLULAR AND WIFI

(71) Applicant: Antenna World Inc., Doral, FL (US)

(72) Inventor: Raul J. Pla, Doral, FL (US)

(73) Assignee: Antenna World Inc., Doral, FL (US)

( * ) Notice: Subject to any disclaimer, the term of this patent is extended or adjusted under 35 U.S.C. 154(b) by 49 days.

(21) Appl. No.: 16/356,320

(22) Filed: Mar. 18, 2019

(65) Prior Publication Data

US 2020/0328523 A1 Oct. 15, 2020

(51) Int. Cl.
*H01Q 13/02* (2006.01)
*H01Q 1/12* (2006.01)

(52) U.S. Cl.
CPC ..... *H01Q 13/02* (2013.01); *H01Q 1/125* (2013.01)

(58) Field of Classification Search
CPC .... H01Q 13/106; H01Q 13/085; H01Q 13/02; H01Q 19/13; H01Q 15/16
See application file for complete search history.

(56) References Cited

U.S. PATENT DOCUMENTS 3,286,268 A 11/1966 Barbano
3,780,375 A * 12/1973 Cummings ..... H01Q 15/161 343/915
4,763,131 A 8/1988 Rosser et al.
9,041,613 B1 5/2015 Lin et al.
9,742,069 B1 * 8/2017 Hollenbeck ..... H01Q 19/13
2002/0101384 A1 * 8/2002 Brooker ..... H01Q 19/132 343/757
2007/0052607 A1 * 3/2007 Dwornik ..... H01Q 3/08 343/766
2009/0295654 A1 * 12/2009 Baker ..... H01Q 1/125 343/713
2012/0026065 A1 * 2/2012 Lo ..... H01Q 1/1228 343/890

(Continued)

OTHER PUBLICATIONS

Log periodic dipole array with parasitic elements by Norman Barbano (Sylvania Electronic Systems Government Systems Management for General Telephone & Electronics. Dated Mar. 30, 1964. Unclassified (AD 433172) Defense Documentation Center for Scientific and Technical Information.

(Continued)

*Primary Examiner* — Raymond R Chai
(74) *Attorney, Agent, or Firm* — Albert Bordas, P.A.

(57) ABSTRACT

An antenna having a feed horn assembly, a parabolic reflector assembly, and a mounting bracket assembly. The feed horn assembly has a circuit board housing having first and second molded housing halves and a main support arm. The feed horn assembly is adjustable, whereby the main support arm is adjusted from a collapsed configuration to an elongated configuration and vice-versa. The feed horn assembly further has a printed circuit board, a coaxial feed cable, an arm holder, and a coaxial radio frequency connector. The printed circuit board is triangular in shape. The circuit board housing houses the printed circuit board. The main support arm has a plurality of arm adjustment holes and extends from the arm holder to the circuit board housing. From the collapsed configuration to the elongated configuration there are intermediate configurations. The antenna has single polarization.

19 Claims, 8 Drawing Sheets

(56) References Cited

U.S. PATENT DOCUMENTS

| | | | | |
|---|---|---|---|---|
| 2013/0141307 | A1* | 6/2013 | Nurnberger | H01Q 15/16 343/912 |
| 2013/0271337 | A1* | 10/2013 | Lee | H01Q 19/134 343/840 |
| 2014/0152492 | A1* | 6/2014 | Zimmerman | H01Q 1/08 342/352 |
| 2016/0156107 | A1* | 6/2016 | Lee | H01Q 15/141 343/840 |
| 2016/0352022 | A1* | 12/2016 | Thomson | H01Q 1/288 |
| 2017/0025745 | A1* | 1/2017 | Clayton | H01Q 1/1228 |
| 2018/0294543 | A1* | 10/2018 | Barratt | H01Q 1/088 |
| 2019/0097309 | A1* | 3/2019 | Marrero-Fontanez | H01Q 1/125 |
| 2019/0190165 | A1* | 6/2019 | Biancotto | H01Q 9/04 |

OTHER PUBLICATIONS

Log periodic dipole array with parasitic by Norman Barbano. Published on Oct. 1965 by Loyola Marymount University, Microwave Journal, vol. 8, pp. 41-69.

Dual-polarization monopulse antennas utilizing conical arrays of log-periodic antennas by DuHamel, et al. Published by Antennas and Propagation Society International Symposium on Dec. 1966. Broadband Antennas, p. 159-166. Section II-A. https://ieeexplore.ieee.org/stamp/stamp.jsp?tp=&arnumber=1150428.

Analysis and applications of log-periodic monopole arrays by Schaubert, et al. Published on Feb. 1995 by Proceedings of the 1994 Antenna Applications Symposium, RL-TR-95-47, vol. I.

Printed circuit board implementation of log-periodic parasitic monopole arrays by Ingerson, et al. Published by Proceedings of the 2001 Antenna Applications Symposium on Jul. 17, 2002. vol. I, p. 214-230.

* cited by examiner

Chart A

Chart B

Chart C

WIDE BAND LOG PERIODIC REFLECTOR ANTENNA FOR CELLULAR AND WIFI

BACKGROUND OF THE INVENTION

1. Field of the Invention

The present invention relates to antennas, and more particularly, to parabolic antennas with wide-band, broadband feed horns, and usable across an extremely wide bandwidth of radio frequencies and highly directive.

2. Description of the Related Art

Applicant believes that one of the closest references corresponds to U.S. Pat. No. 9,041,613 B1 issued to Lin, et al. on May 26, 2015 for High gain dish antenna with a tapered slot feed. However, it differs from the present invention because Lin, et al. teach a broadband antenna that includes a different wide-band feed horn and support mechanism. This antenna uses a tapered slot wide band antenna and is supported by traditional heavy and complex high cost methods to the parabolic reflector. Such antenna of slot feed, heavy weight and relatively high cost differs mechanically and electrically.

Applicant believes that another reference corresponds to U.S. Pat. No. 3,286,268 issued to Normand Barbano on Nov. 15, 1966 for Log periodic antenna with parasitic elements interspersed in log-periodic manner. However, it differs from the present invention because Barbano teaches broadband antennas to improved log periodic dipole and monopole antenna arrays.

Applicant believes that another reference corresponds to U.S. Pat. No. 4,763,131 issued to Rosser, et al. on Aug. 9, 1988 for Log-periodic monopole antenna array. However, it differs from the present invention because Rosser, et al. teach a log-periodic monopole antenna array having parasitic elements and means for grounding such elements to a non-solderable ground structure.

Applicant believes that another reference corresponds to Non-Patent literature published on Mar. 30, 1964 to Norman Barbano for Log periodic dipole array with parasitic elements. However, it differs from the present invention because Barbano teaches a design and measured characteristics of dipole and monopole versions of a log periodic array with parasitic elements. In a dipole array with parasitic elements, these elements are used in place of every alternate dipole, thereby eliminating the need of a twisted feed arrangement for the elements to obtain log periodic performance of the antenna. This design with parasitic elements lends itself to a monopole version of the antenna, which has a simplified feeding configuration. The log periodic antenna design is used from high frequencies through microwave frequencies.

Applicant believes that another reference corresponds to Non-Patent literature disclosed on Jan. 30, 1964 by Norman Barbano (Prepared for the U. S. Army Electronics Research and Development Laboratory under Contract DA 36-039 AMC-00088 (E)) for Log periodic dipole array with parasitic. However, it differs from the present invention because Barbano teaches a modified design of a log-periodic dipole array fed in phase progression rather than in phase reversal such that the antenna will produce backfire radiation and operate in a pseudofrequency-independent manner.

Applicant believes that another reference corresponds to Non-Patent literature disclosed by DuHamel, et al. on December 1966 for Dual-polarization monopulse antennas utilizing conical arrays of log-periodic antennas. However, it differs from the present invention because DuHamel, et al. teach an antenna system having N log-periodic monopole antenna fed against a central conducting cone and a feed network comprised of a multiplicity of magic-$T^1$s and quadrature hybrids. The antenna elements are placed on the cone in a rotationally symmetric manner such that a rotation about the cone axis of $2\pi/N$ radians leaves the antenna unchanged. With the proper feed network, rotationally symmetric sum and difference patterns may be produced for both left and right circular polarizations simultaneously.

Applicant believes that another reference corresponds to Non-Patent literature published on February 1995 by Daniel H. Schaubert, et al. at Proceedings of the 1994 Antenna Applications Symposium, for Analysis and applications of log-periodic monopole arrays. However, it differs from the present invention because Daniel H. Schaubert, et al. teach multi-arm antennas, empirically determined, with bandwidth up to 20:1. Analytical model appear to be able to predict the important aspects of the antenna and allows the designs to be optimized and modified for particular applications.

Applicant believes that another reference corresponds to Non-Patent literature disclosed on Jul. 17, 2002 by Ingerson, et al. at Proceedings of the 2001 Antenna Applications Symposium—Volume I, for Printed circuit board implementation of log-periodic parasitic monopole arrays. However, it differs from the present invention because Ingerson, et al. teach log-periodic dipole and monopole arrays, which include parasitic elements between the driven elements, and the method of implementing log-periodic parasitic monopole arrays (LPPMA) on printed circuit boards (PBC).

Other documents describing the closest subject matter provide for a number of more or less complicated features that fail to solve the problem in an efficient and economical way. None of these patents suggest the novel features of the present invention.

SUMMARY OF THE INVENTION

The present invention is an antenna, comprising a feed horn assembly having a circuit board housing with first and second molded housing halves, and a main support arm.

The feed horn assembly is adjustable, whereby the main support arm is adjusted from a collapsed configuration to an elongated configuration and vice-versa. The present invention further comprises a parabolic reflector assembly and a mounting bracket assembly.

The feed horn assembly further comprises a printed circuit board, coaxial feed cables, an arm holder, and a coaxial radio frequency connector. The first and second housing halves each comprise a molded housing distal end, a molded housing proximal end, and first and second lateral sides respectively. The molded housing distal end comprises a first predetermined length. The molded housing proximal end comprises a second predetermined length. The first predetermined length is greater than the second predetermined length. The first and second molded housing halves comprise first and second molded housing edges respectively. The first and second molded housing edges align to seal the first and second molded housing halves to each other. The printed circuit board is triangular in shape. The circuit board housing houses the printed circuit board. The main support arm comprises a plurality of arm adjustment holes. The arm holder comprises arm fastener holes and arm holder attachment tabs.

The parabolic reflector assembly comprises an internal side, an external side, a parabolic reflector, and a feed horn mounting plate. The arm holder extends approximately from a center section of the internal side and is secured onto the feed horn mounting plate. The arm holder holds the main support arm. The main support arm extends from the arm holder to the circuit board housing. The main support arm is secured into the arm holder with a pin, whereby the arm fastener holes are aligned with any pair of arm adjustment holes to receive the respective pin. From the collapsed configuration to the elongated configuration there are intermediate configurations, wherein the collapsed, elongated, and intermediate configurations are achieved with a plurality of arm adjustment holes to direct rays hitting parabolic reflector at a focal point on feed horn assembly.

The mounting bracket assembly comprises first and second bracket walls, first and second U-shaped bolts, and first and second mast clamps, and the antenna comprises single polarization.

It is therefore one of the main objects of the present invention to provide an antenna, which has a feed horn assembly and a parabolic reflector assembly.

It is another object of this invention to provide an antenna having a feed horn assembly that is adjustable.

It is another object of this invention to provide an antenna having single polarization.

It is another object of this invention to provide an antenna that is volumetrically efficient for carrying, transporting, and storage.

It is another object of this invention to provide an antenna that can be readily assembled and disassembled without the need of any special tools.

It is another object of this invention to provide an antenna, which is of a durable and reliable construction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
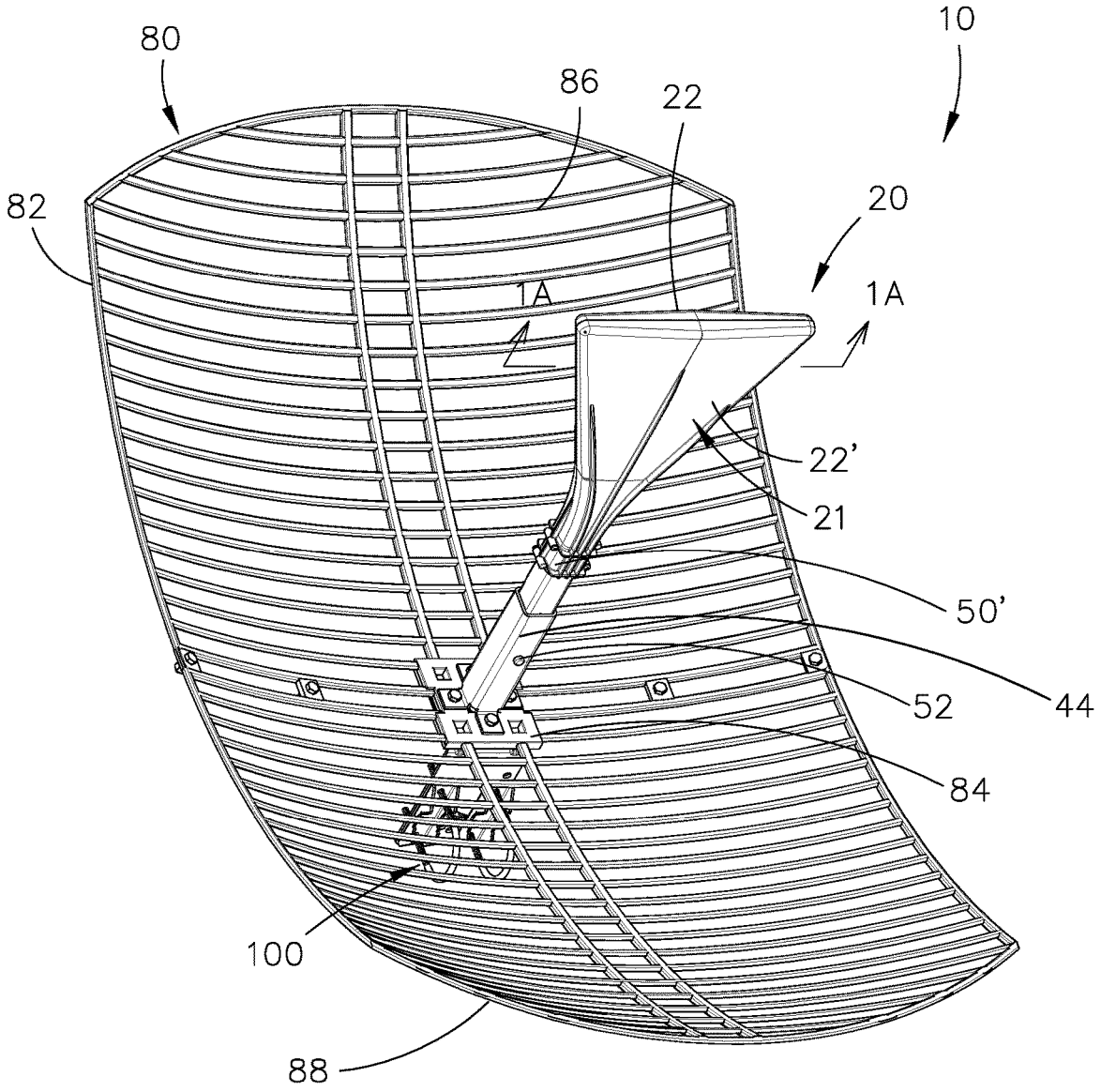
FIG. 1 is an isometric view of the present invention.

Referring now to the drawings, the present invention is a wide band log periodic reflector antenna for cellular and Wifi, also referred to as antenna, and is generally referred to with numeral 10. It can be observed that it basically includes feed horn assembly 20, parabolic reflector assembly 80, and mounting bracket assembly 100.

Antenna 10 is a commercial grade, popularly consumer-useful, lightweight, and easy to install LPDA-Parabolic (LPDAP) antenna. In a preferred embodiment, antenna 10 is wide band log periodic reflector antenna for cellular and Wifi. Antenna 10 will be easily purchased by users for long-range 3G, 4G, 5G cellular voice & data, Long range Wifi, Software-Defined-Radios, Satellite Radio (SDARS), Direction-finders, Scanners, Spectrum search, RF energy harvesting, GPS, Radio Telescope, Amateur radio, public-safety, Homeland Security, and military for rapid or temporary deployment.

Antenna 10 is of a lightweight yet robust construction with highly optimized performance for its size. Intended use locations are on private homes, offices, buildings, schools, electronic laboratories, emergency/back-up uses.

As seen in FIG. 1, feed horn assembly 20 comprises circuit board housing 21. Circuit board housing 21 comprises first and second molded housing halves 22 and 22'.

Parabolic reflector assembly 80 comprises parabolic reflector 82, feed horn mounting plate 84, internal side 86, and external side 88. Feed horn assembly 20 is mounted onto internal side 86, whereby arm holder 44 extends approximately from a center section of internal side 86 and is secured onto feed horn mounting plate 84. In a preferred embodiment, parabolic reflector 82 is truncated.

Parabolic reflector 82 may be grid style, i.e. made of evenly and non-evenly spaced vertical, diagonal and horizontal rods, tubes or cast and molded metal or metalized reflective non-metal materials. Parabolic reflector 82 may also be made of sheet metal material. The sheet metal may be stamped or formed with or without perforations for weight reduction and wind through passing. Parabolic reflector 82 may also be made of reflective material or dielectric material, however with a reflective surface. In a preferred embodiment, parabolic reflector 82 comprises a round outline, rectangle outline, oval outline or bowtie outline. It may also comprise truncated round outline or edges.

Mounting bracket assembly 100 is also mounted onto parabolic reflector assembly 80. Specifically, mounting bracket assembly 100 secures parabolic reflector assembly 80 with feed horn assembly 20, onto a structure that supports antenna 10. Although not illustrated, such a structure can be, but is not limited to, a pole, post, building, or any supporting structure.

Figure 1A:
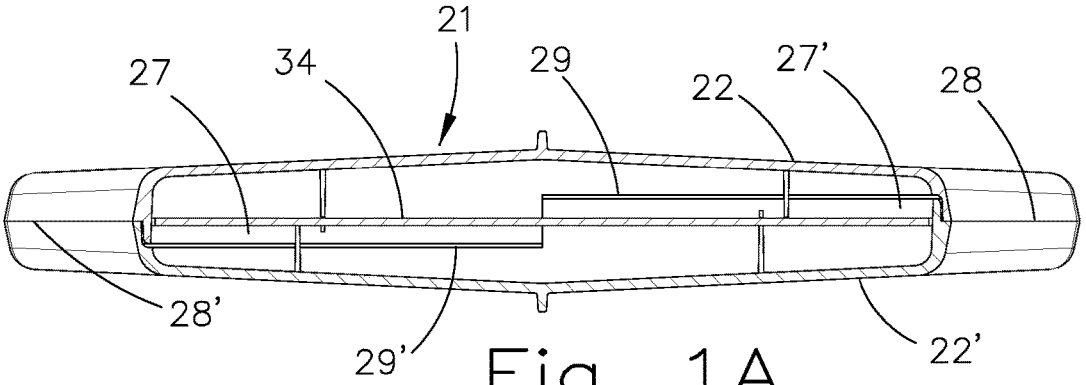
FIG. 1A is a cut view taken along lines 1A-1A from FIG. 1.

As seen in FIG. 1A, first and second molded housing halves 22 and 22' further comprise respective molded housing edges 28 and 28' along their perimeters, whereby first and second molded housing edges 28 and 28' align to seal first and second molded housing halves 22 and 22' to each other. Housing edges 28 and 28' comprise respective overlapping external lips 27 and 27' and respective internal notches 29 and 29' to interlock respective surfaces. From a first section of each molded housing edge 28 and 28' extends respective external lips 27 and 27', and under a second section of each molded housing edge 28 and 28' there are respective internal notches 29 and 29'. External lips 27 and 27' and internal notches 29 and 29' comprise an adhesive surface, allowing for first and second molded housing halves 22 and 22' to seal to each other.

In another embodiment, first and second molded housing halves 22 and 22' are sealed to each other with screws or adhesive pins along an internal perimeter to secure circuit board housing 21.

Figure 2:
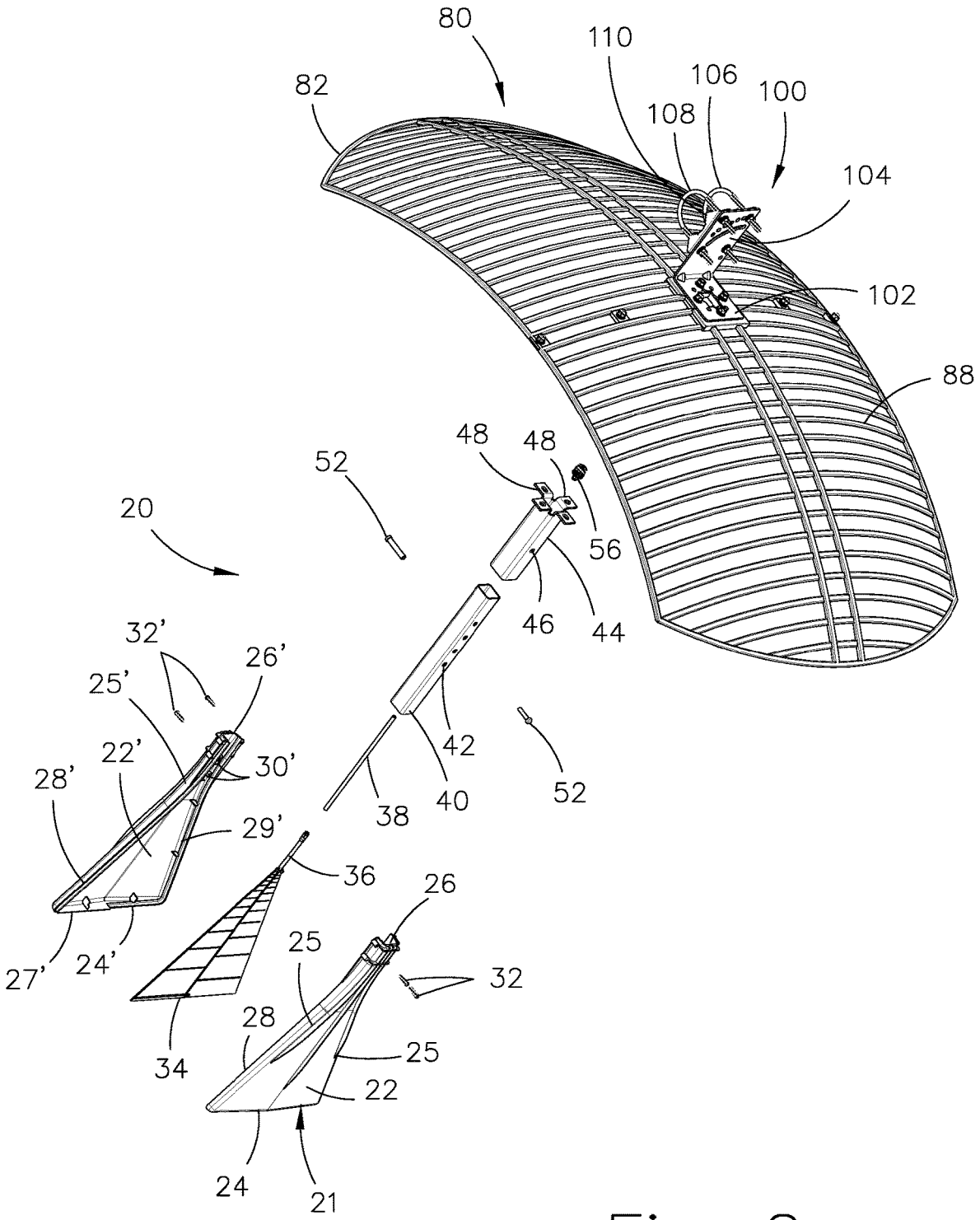
FIG. 2 is an exploded view of the present invention.

As seen in FIG. 2, feed horn assembly 20 further comprises main support arm 40, printed circuit board 34, coaxial feed cables 36 and 38, arm holder 44, and coaxial radio frequency (RF) connector 56. Coaxial feed cable 36 extends from printed circuit board 34 to connect with coaxial feed cable 38. In another embodiment, coaxial feed cables 36 and 38 may be a single cable.

Main support arm 40 comprises a plurality of arm adjustment holes 42. Arm holder 44 comprises arm fastener holes 46 and arm holder attachment tabs 48. In a preferred embodiment, there are two arm fastener holes 46 positioned relatively centered on opposite faces. Arm holder 44 may be a single piece or two pieces assembled. Arm holder attachment tabs 48 are mounted onto feed horn mounting plate 84, seen in FIG. 1, to fix feed horn assembly 20 onto parabolic reflector assembly 80. In a preferred embodiment, nuts and bolts fix arm holder attachment tabs 48. Arm holder attachment tabs 48 are designed in a predetermined size and shape with proper spacing to fit easily onto a grid type parabolic reflector 82 most commonly used for Wifi networks in a consumer/end-user market. Arm holder attachment tabs 48 are also adapted to non-standard grid reflectors using a simple adapter plate, not illustrated.

Mounting bracket assembly 100 comprises first and second bracket walls 102 and 104. First and second bracket walls 102 and 104 are approximately perpendicular to each other, wherein first bracket wall 102 is fixedly mounted onto external side 88 of parabolic reflector assembly 80. First and second U-shaped bolts 106 and 108 are mounted onto second bracket wall 104 with respective mast clamps 110.

Figure 3:
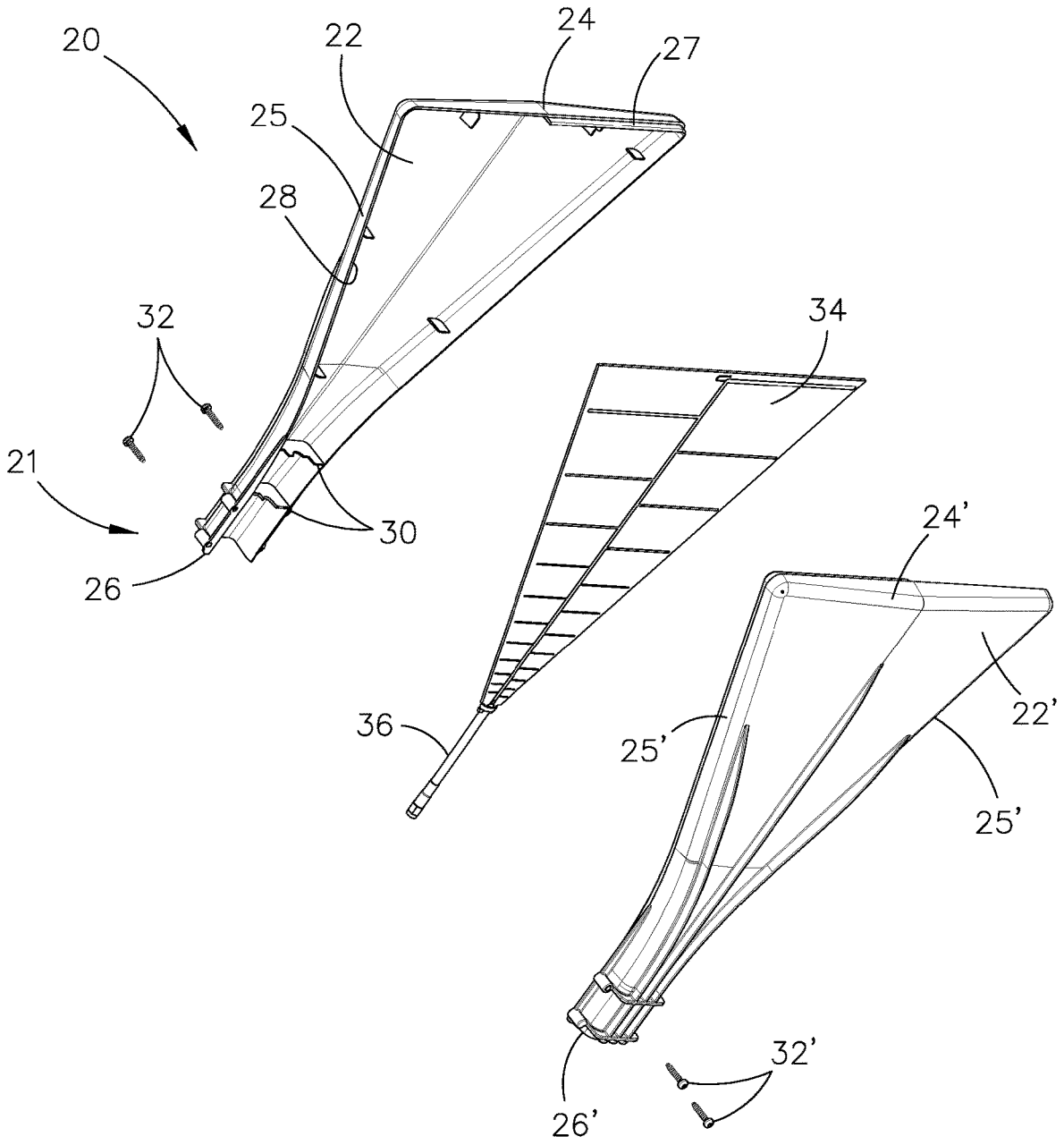
FIG. 3 is an exploded view of a circuit board housing of the present invention.
Figure 4:
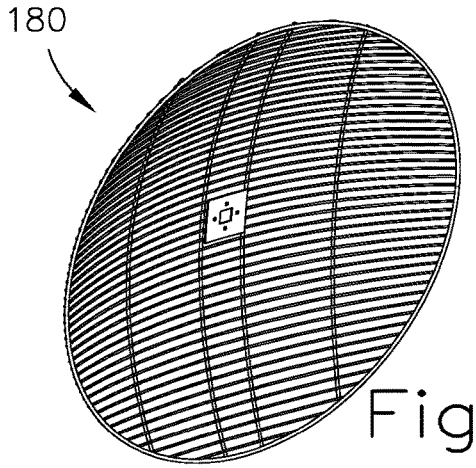
FIG. 4 is an isometric view of a first alternative configuration of a parabolic reflector.
Figure 5:
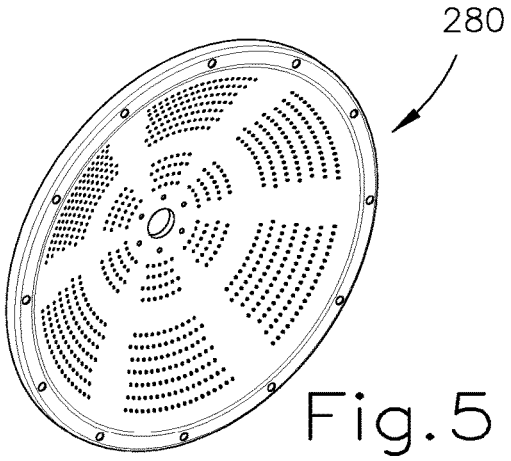
FIG. 5 is an isometric view of a second alternative configuration of the parabolic reflector.
Figure 6:
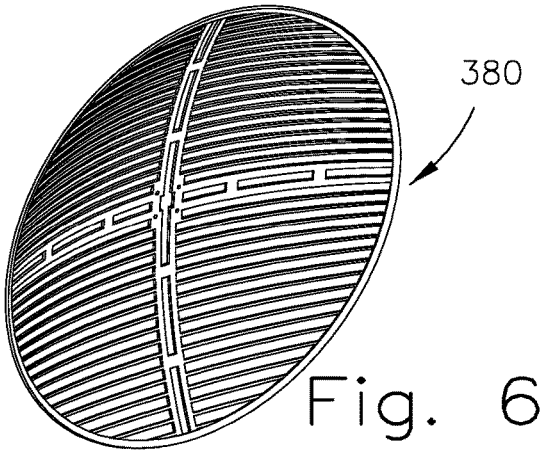
FIG. 6 is an isometric view of a third alternative configuration of the parabolic reflector.

As seen in FIG. 3, feed horn assembly 20 comprises circuit board housing 21. Circuit board housing 21 is a molded special plastic material to withstand outdoor elements. Circuit board housing 21 houses printed circuit board 34, whereby circuit board housing 21 houses and positions printed circuit board 34 within. Printed circuit board 34 is carefully spaced and tuned for circuit board housing 21. Circuit board housing 21 is cleverly designed for lightweight, easy assembly, and water tightness. Printed circuit board 34 is triangular in shape. First and second molded housing halves 22 and 22' comprise respective supporting structures 30 and 30', seen in FIG. 1, to receive and hold printed circuit board 34 and coaxial feed cable 36.

First molded housing half 22 comprises first molded housing distal end 24, first and second lateral sides 25, and first molded housing proximal end 26. Second molded housing half 22' comprises second molded housing distal end 24', first and second lateral sides 25', and second molded housing proximal end 26'. Housing screws 32 and 32' are positioned close to respective first and second molded housing proximal ends 26 and 26' to secure molded housing half 22 and molded housing half 22' to one another.

Molded housing distal end 24 comprises a first predetermined length that extends between first and second lateral sides 25. Molded housing distal end 24' comprises the same first predetermined length that extends between first and second lateral sides 25'.

Molded housing proximal end 26 comprises a second predetermined length that extends between first and second lateral sides 25. Molded housing proximal end 26' comprises the same second predetermined length that extends between first and second lateral sides 25'.

The first predetermined length is greater than the second predetermined length. In a preferred embodiment, lateral sides 25 and 25' define an angle of approximately 30 degrees respectively.

Figure 7:
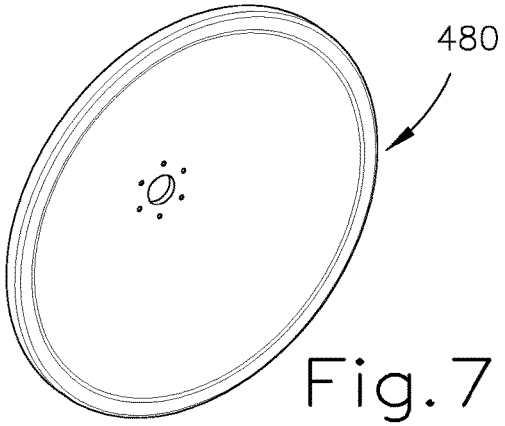
FIG. 7 is an isometric view of a fourth alternative configuration of the parabolic reflector.

As seen in FIGS. 4, 5, 6, and 7, parabolic reflector assembly 80, as seen in FIG. 1, may comprise alternative configurations. Alternative configurations are selected from parabolic reflector assembly 180, parabolic reflector assembly 280, parabolic reflector assembly 380, and parabolic reflector assembly 480. In a preferred embodiment, parabolic reflector assembly 180, parabolic reflector assembly 280, parabolic reflector assembly 380, and parabolic reflector assembly 480 are parabolic dishes. Solid reflectors, as seen in FIG. 7, may be also used.

Figure 8:
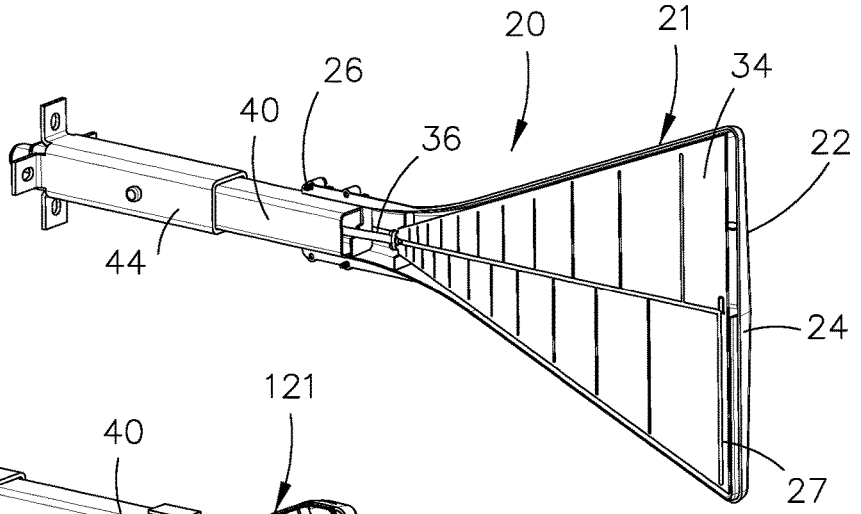
FIG. 8 is an isometric view of a feed horn assembly.
Figure 9:
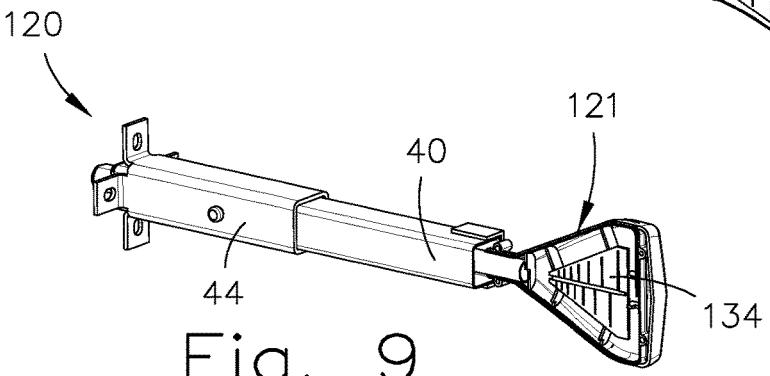
FIG. 9 is an isometric view of a first alternative configuration of the feed horn assembly.

As seen in FIGS. 8 and 9, arm holder 44 holds main support arm 40. Main support arm 40 extends from arm holder 44 to circuit board housing 21.

In another embodiment, feed horn assembly 20 comprises an alternative configuration having feed horn assembly 120, wherein circuit board housing 121 and printed circuit board 134 are smaller than circuit board housing 21 and printed circuit board 34.

Figure 10:
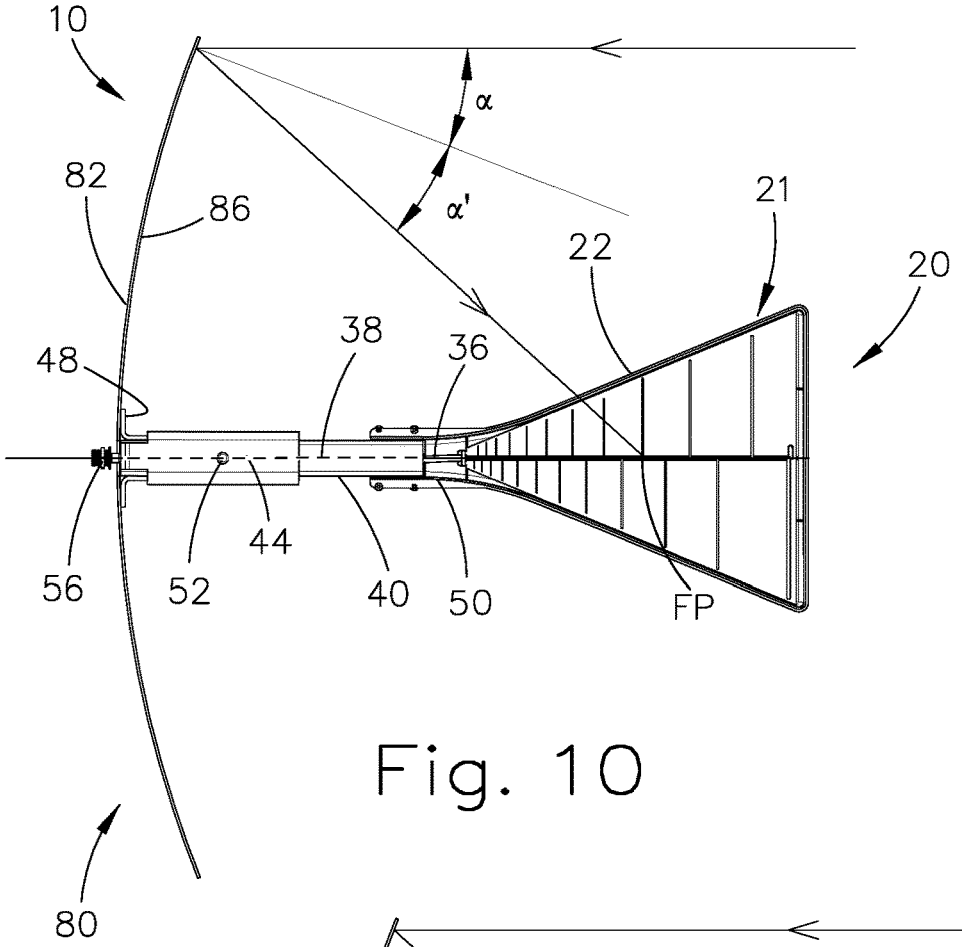
FIG. 10 is a lateral view of the present invention without a molded housing half and showing an angle of incidence and an angle of reflection.
Figure 11:
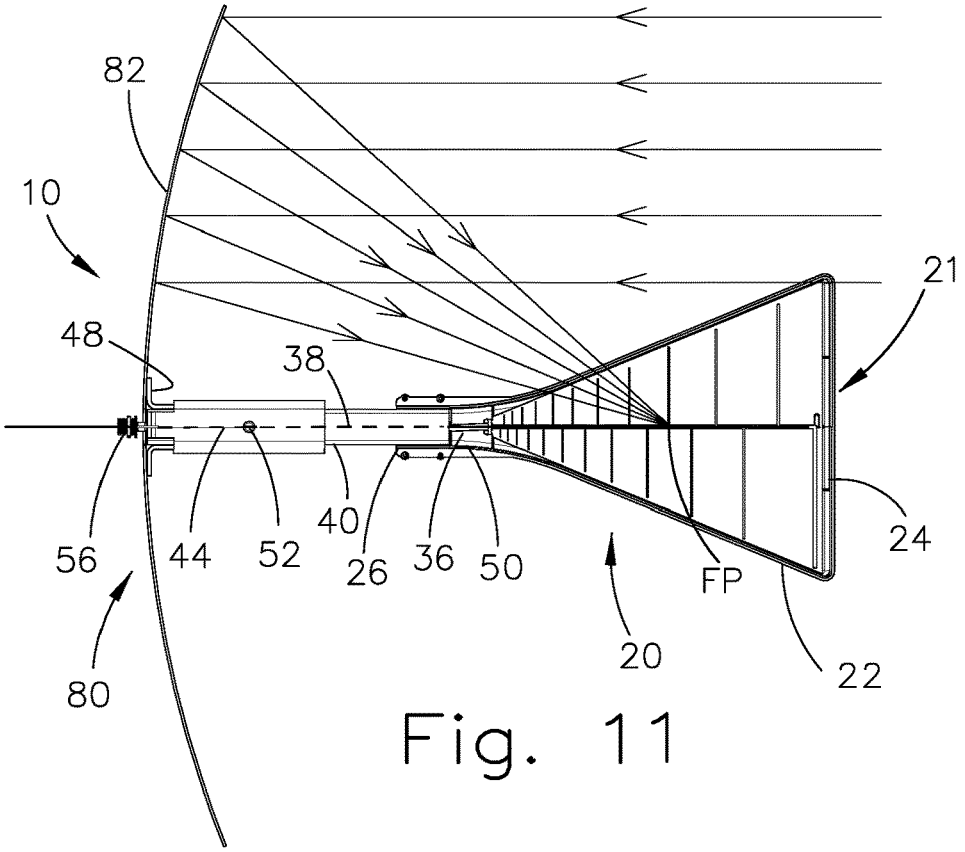
FIG. 11 is a lateral view of the present invention without the molded housing half showing how a parabolic reflector directs radio waves in a narrow beam.

As seen in FIGS. 10 and 11, arm holder 44 extends approximately from a center section of internal side 86.

Housing noses 50, and 50' seen in FIG. 1, attach to support main support arm 40, whereby main support arm 40 is inserted inside housing noses 50, and 50' seen in FIG. 1, and molded housing halves 22, and 22' seen in FIG. 3, overlap to secure it. An adhesive or housing screws 32 and 32', seen in FIG. 3, are used to assure that a firm and strong grip secures the connection/joint.

Main support arm 40 is made of RF transparent material carefully adjusted to minimize frontal signal distortion or alteration. The material is an especially thin wall epoxy composite including fiberglass cloth. Main support arm 40 is carefully designed to handle without breakage or bending due to wind pressure loadings encountered by feed horn assembly 20. Main support arm 40 may be mechanically adjusted to change a distance of feed horn assembly 20 to parabolic reflector assembly 80.

Main support arm 40 is secured into arm holder 44, whereby arm holder 44 is designed to snugly hold main support arm 40 and provides for an adjustable feature by sliding and using preset arm fastener holes 46, seen in FIG. 2.

Coaxial feed cable 38 passes inside main support arm 40 to connect to coaxial radio frequency (RF) connector 56. Antenna 10 has single polarization.

Signals having angle of incidence $\alpha$ and angle of reflection $\alpha'$ are reflected on parabolic reflector 82 to direct all rays hitting parabolic reflector 82 at focal point FP. The angles of the parabolic curvature of parabolic reflector 82 send all the rays gathered in a large diameter to one intense location, i.e., focal point FP. There are several numbers of rays and different values for angles $\alpha$ and $\alpha'$.

Figure 12:
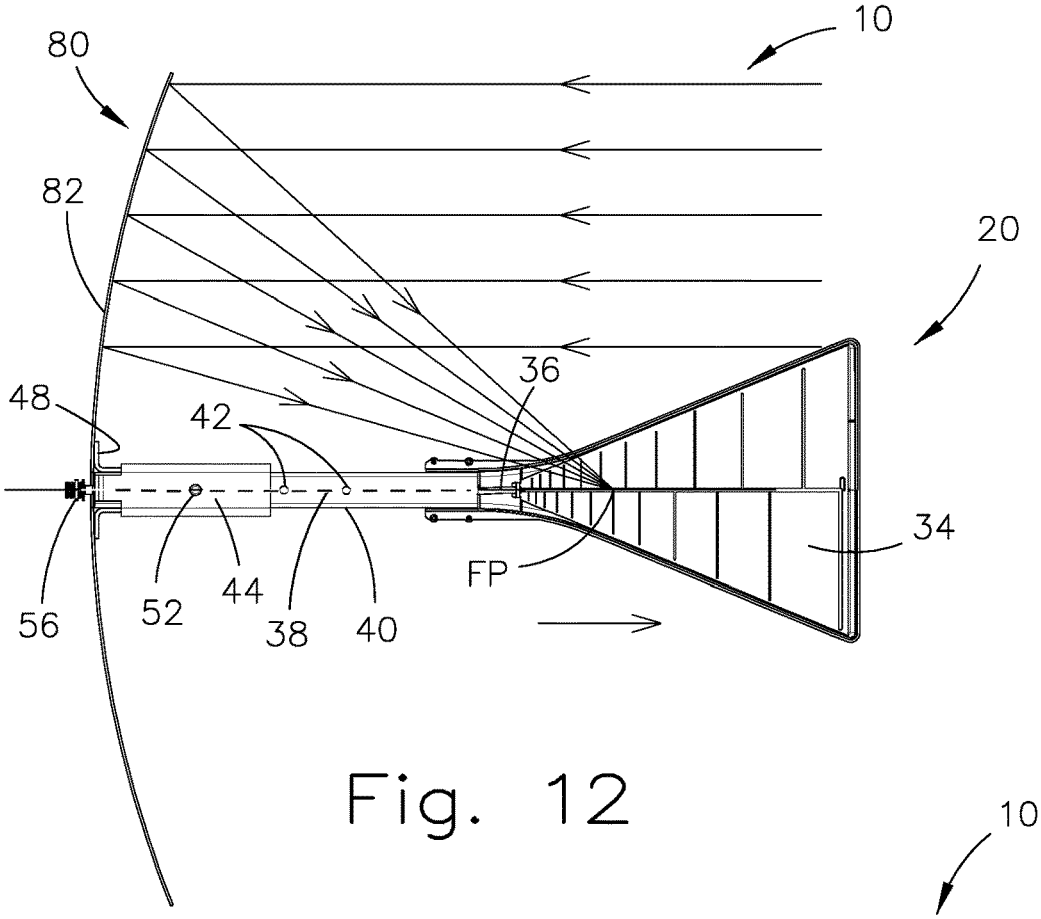
FIG. 12 is a lateral view of the present invention with the main support arm in an elongated configuration having a first position of the Focal Point.
Figure 13:
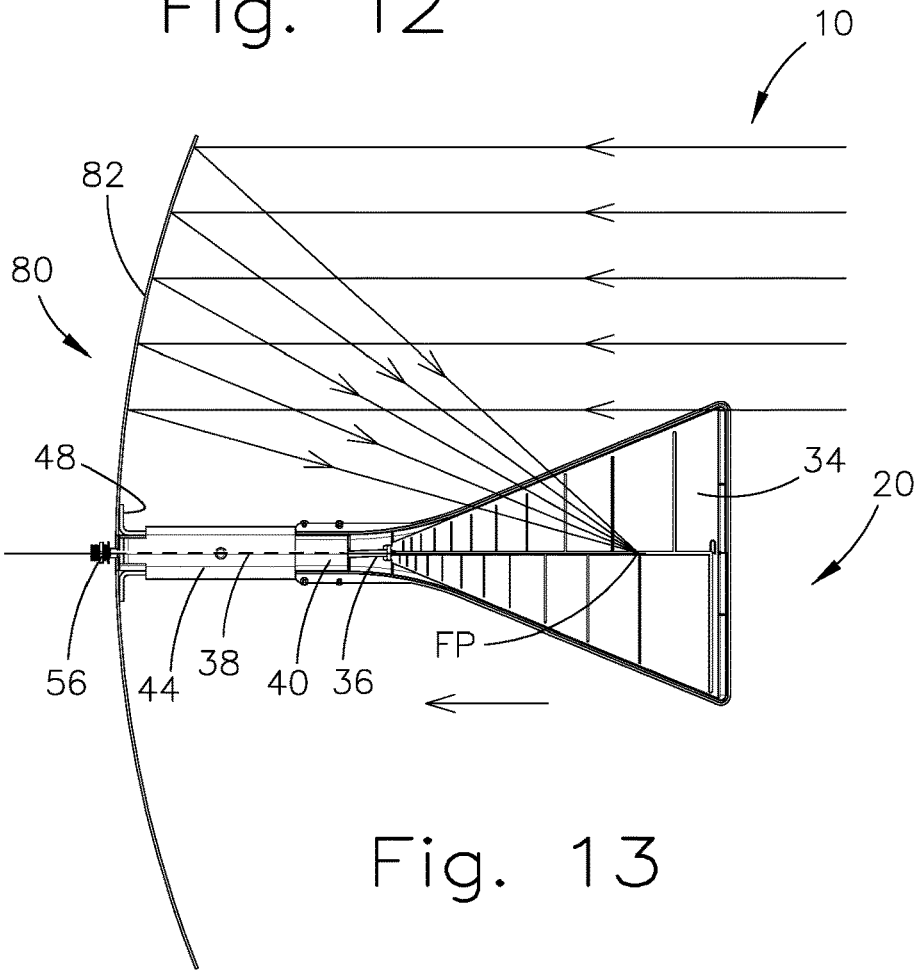
FIG. 13 is a lateral view of the present invention with the main support arm in a collapsed configuration having a second position of the Focal Point.

As seen in FIGS. 12 and 13, main support arm 40 may be mechanically adjusted to increase or decrease the distance of feed horn assembly 20 from parabolic reflector assembly 80. Feed horn assembly 20 is adjustable to preset lengths, whereby main support arm 40 is adjusted from a collapsed configuration to an elongated configuration. From the collapsed configuration to the elongated configuration there are intermediate configurations. The collapsed, elongated, and intermediate configurations are achieved with a plurality of arm adjustment holes 42. In a preferred embodiment, preset adjustment lengths are approximately at one-inch intervals, however larger and smaller intervals can be incorporated.

Arm fastener holes 46, seen in FIG. 2, are positioned to align with any pair of arm adjustment holes 42, according to a desired position, and both receive respective arm length fastener pin 52 which secure main support arm 40 inside arm holder 44. From the collapsed configuration to the elongated configuration, focal point FP changes its position.

Antenna 10 is factory assembled at a best ideal length to provide excellent gain across the design bandwidth. The feature of an adjustable feed horn assembly 20 allows the more precise focal point FP of parabolic reflector 82. In another embodiment, adjustment can be made with a slider mechanism, not illustrated.

Feed horn assembly 20 includes a novel feature to permit optimizing or maximizing forward power at an upper end of its design range or a lower end of its design range.

Feed horn assembly 20 is made of a standard FR4 printed circuit board 34. High performance printed circuit material may also be used. Metallic elements formed by sheet metal, metal tube, or metal rods may also be used in lieu of printed circuit board 34. Antenna 10 elements are printed on loading material, which makes feed horn assembly 20 more compact and increases the beam width to better illuminate the parabolic reflector 82.

Figure 14A:
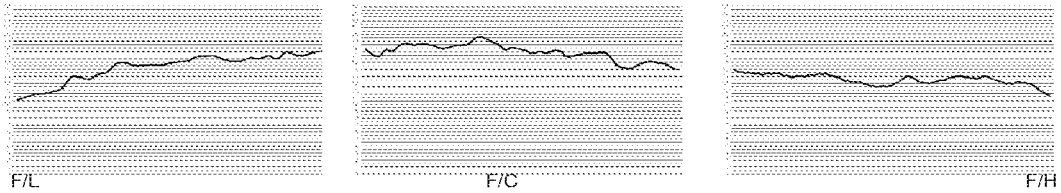
FIG. 14A illustrates a chart showing detail test results obtained with the present invention.
Figure 14B:
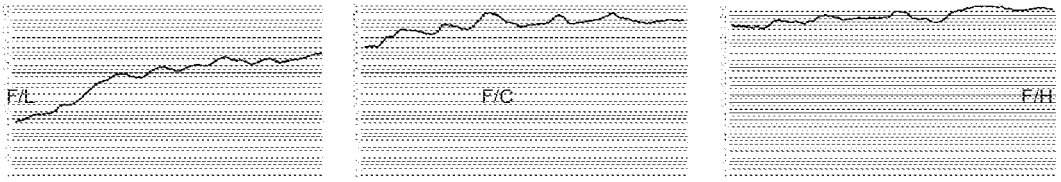
FIG. 14B illustrates a chart showing detail test results obtained with the present invention.
Figure 15:
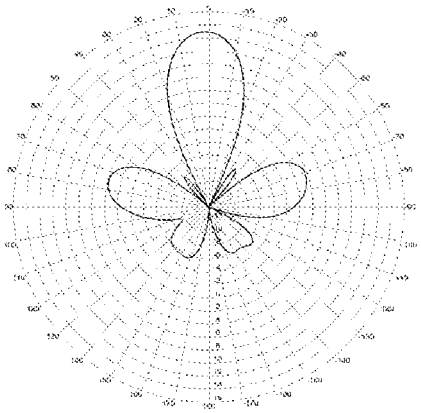
FIG. 15 illustrates charts showing detail test results obtained with the present invention.
Figure 15:
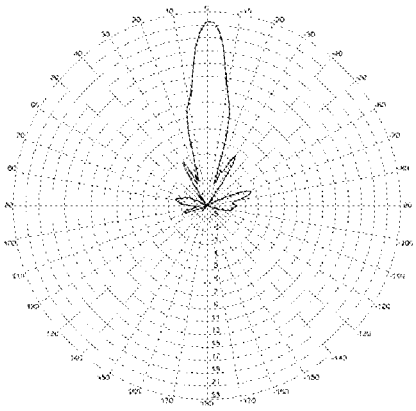
Figure 15:
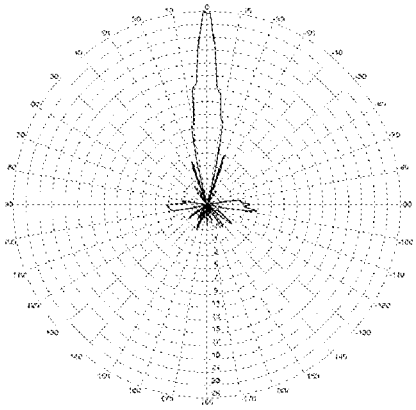

As seen in FIGS. 14A, 14B, and 15, charts detail test results obtained with present invention 10.

FIG. 14A comprises chart series plots of Antenna 10 forward power gain dBi at 0 degrees Vs. Frequency having feed horn positioned inward, which favors lower frequencies within the operational bandwidth of antenna system of present invention 10.

F/L chart with typical plotted performance, absolute gain measured in dBi of feed horn with small reflector at the lowest portion of the operational bandwidth of antenna 10.

F/C chart with typical plotted performance, absolute gain measured in dBi of feed horn with small reflector at the middle portion of the operational bandwidth of antenna 10.

F/H chart with typical plotted performance, absolute gain measured in dBi of feed horn with small reflector at the high portion of the operational bandwidth of antenna 10.

FIG. 14B comprises chart series plots of Antenna 10 forward power gain dBi at 0 degrees Vs. Frequency having feed horn positioned outward, which favors lower frequencies within the operational bandwidth of antenna system of present invention 10.

F/L chart with typical plotted performance, absolute gain measured in dBi of feed horn with small reflector at the lowest portion of the operational bandwidth of antenna 10.

F/C chart with typical plotted performance, absolute gain measured in dBi of feed horn with small reflector at the middle portion of the operational bandwidth of antenna 10.

F/H chart with typical plotted performance, absolute gain measured in dBi of feed horn with small reflector at the high portion of the operational bandwidth of antenna 10.

As seen in FIG. 15, charts show typical low band directivity, typical middle band directivity, and typical high band directivity.

Middle, standard position feed horn focal point demonstration of antenna 10 performances, relative typical directivity. Polar chart A illustrates plotted example of absolute gain forward main beam and side lobes at the lowest one third of the feed horn operating bandwidth. Actual measurements using minimal dimension reflector.

Middle, standard position feed horn focal point demonstration of antenna 10 performances, relative typical directivity. Polar chart B illustrates plotted example of absolute gain forward main beam and side lobes covering the middle range of the feed horn operating bandwidth. Actual measurements using minimal dimension reflector.

Middle, standard position feed horn focal point demonstration of antenna 10 performances, relative typical directivity. Polar chart C illustrates plotted example of absolute gain forward main beam and side lobes at the final third of the feed horn operating bandwidth. Actual measurements using minimal dimension reflector.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An antenna, comprising:

a feed horn assembly comprising a circuit board housing having first and second molded housing halves, and a main support aim, said feed horn assembly is adjustable, whereby said main support arm is adjusted from a collapsed configuration to an elongated configuration and vice-versa, wherein said feed horn assembly further comprises a printed circuit hoard and wherein said printed circuit board further comprises a printed circuit hoard antenna;

said printed circuit board is triangular shape, and wherein said printed circuit board antenna comprises a log periodic antenna having a single polarization;

a parabolic reflector assembly, further comprising a parabolic reflector, wherein said collapsed configuration and said elongated configuration are achieved to direct rays hitting said parabolic reflector at a focal point on said feed horn assembly; and a mounting bracket assembly.

2. The antenna set forth in claim 1, further characterized in that said feed horn assembly further comprises coaxial feed cables, an arm holder, and a coaxial radio frequency connector.

3. The antenna set forth in claim 2, further characterized in that said main support arm comprises a plurality of arm adjustment holes.

4. The antenna set forth in claim 3, further characterized in that said arm holder comprises arm fastener holes and arm holder attachment tabs.

5. The antenna set forth in claim 4, further characterized in that said main support arm is secured into said arm holder with a pin, whereby said arm fastener holes are aligned with any pair of said arm adjustment holes to receive said respective pin.

6. The antenna set forth in claim 3, further characterized in that from said collapsed configuration to said elongated configuration there are intermediate configurations, wherein said collapsed configuration, said elongated configuration, and said intermediate configurations are achieved with an element selected from a group of said plurality of arm adjustment holes and a slider mechanism to direct said rays hitting said parabolic reflector at said focal point on said feed horn assembly.

7. The antenna set forth in claim 2, further characterized in that said parabolic reflector assembly further comprises an internal side, an external side, and a feed horn mounting plate.

8. The antenna set forth in claim 7, further characterized in that said arm holder extends approximately from a center section of said internal side and is secured onto said feed horn mounting plate.

9. The antenna set forth in claim 2, further characterized in that said arm holder holds said main support arm.

10. The antenna set forth in claim 2, further characterized in that said main support arm extends from said arm holder to said circuit board housing.

11. The antenna set forth in claim 1, further characterized in that said first and second housing halves each comprise a molded housing distal end, a molded housing proximal end, and first and second lateral sides respectively.

12. The antenna set forth in claim 11, further 1 characterized in that each said molded housing distal end comprises a first predetermined length.

13. The antenna set forth in claim 12, further characterized in that each said molded housing proximal end comprises a second predetermined length.

14. The antenna set forth in claim 13, further characterized in that said first predetermined length is greater than said second predetermined length.

15. The antenna set forth in claim 1, further characterized in that each said first and second molded housing halves comprise first and second molded housing edges respectively.

16. The antenna set forth in claim 15, further characterized in that said first and second molded housing edges align to seal said first and second molded housing halves to each other.

17. The antenna set forth in claim 1, further characterized in that said circuit board housing houses said printed circuit board.

18. The antenna set forth in claim 1, further characterized in that said mounting bracket assembly comprises first and second bracket walls, first and second U-shaped bolts, and first and second mast clamps.

19. An antenna, comprising:

a feed horn assembly comprising a housing having first and second molded housing halves, and a main support arm, said feed horn assembly is adjustable, whereby said main support arm is adjusted from a collapsed configuration to an elongated configuration and vice-versa, wherein said feed horn assembly further comprises a log periodic antenna, wherein at least one metallic element of said log periodic antenna is formed by at least one item selected from a group of a sheet metal, a metal tube, and a metal rod;

a parabolic reflector assembly, further comprising a parabolic reflector, wherein said collapsed configuration and said elongated configuration are achieved to direct rays hitting said parabolic reflector at a focal point on said feed horn assembly; and a mounting bracket assembly.

* * * * *